US009901172B2

(12) United States Patent
Linares

(10) Patent No.: US 9,901,172 B2
(45) Date of Patent: Feb. 27, 2018

(54) PALLET HILO FORK GUARD, A COATED INSERT INCORPORATED INTO SUCH AS A VEHICLE PASSENGER COMPARTMENT SHELF, AND AN ASSEMBLEABLE AND PLASTIC COATED CONTAINERS FOR HOLDING BAGGED ITEMS

(71) Applicant: Oria Collapsibles, LLC, Auburn Hills, MI (US)

(72) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 343 days.

(21) Appl. No.: 14/666,916

(22) Filed: Mar. 24, 2015

(65) Prior Publication Data

US 2015/0265050 A1 Sep. 24, 2015

Related U.S. Application Data

(60) Provisional application No. 61/969,633, filed on Mar. 24, 2014.

(51) Int. Cl.
*B65D 19/06* (2006.01)
*A47B 96/02* (2006.01)
(Continued)

(52) U.S. Cl.
CPC ..... *A47B 96/021* (2013.01); *B65D 3/04* (2013.01); *B65D 5/62* (2013.01); *B65D 19/0073* (2013.01);
(Continued)

(58) Field of Classification Search
CPC ..... B65D 2519/00323; B65D 2519/00273; B65D 2519/00034; B65D 2519/00069;
(Continued)

(56) References Cited

U.S. PATENT DOCUMENTS 2,868,487 A * 1/1959 Robinson ..... B65D 19/0012 108/57.1
3,207,049 A 9/1965 Monroe
(Continued)

FOREIGN PATENT DOCUMENTS

DE 3107727 * 9/1982
FR 2568856 * 2/1986
(Continued)

*Primary Examiner* — Janet M Wilkens
(74) *Attorney, Agent, or Firm* — Dinsmore & Shohl LLP

(57) ABSTRACT

A structurally supporting shelf article having a body and a plasticized coating applied to at least an exterior of the article. The body further includes a planar shaped insert surrounded by a tubular frame. In a further variant, a structurally supporting pallet article includes a body incorporating a planar shaped upper supporting surface, the body further including rectangular shaped reinforcing brackets incorporated into a structurally supporting underside locations of the body and which are adapted to receive the inserting forks of a forklift device. A plasticized coating can be applied to at least an exterior of the body. In another variant, a reinforced and volume supporting paperboard article includes a four-sided box like structure assembleable upon a pallet-shaped base with a lid affixing to the assembled sides. The body may constitute a cardboard constructed barrel with reinforcing upper and lower tubular support portions, the lid affixing over an open top of the barrel. In a further application, the body is a cardboard box with upper extending flaps.

7 Claims, 7 Drawing Sheets

(51) Int. Cl.

| | |
|---|---|
| ***B65D 3/04*** | (2006.01) |
| ***B65D 25/34*** | (2006.01) |
| ***B65D 19/00*** | (2006.01) |
| ***B65D 5/62*** | (2006.01) |

(52) U.S. Cl.
CPC ..... *B65D 19/06* (2013.01); *B65D 25/34* (2013.01); *B65D 2519/00019* (2013.01); *B65D 2519/00029* (2013.01); *B65D 2519/00034* (2013.01); *B65D 2519/00044* (2013.01); *B65D 2519/00054* (2013.01); *B65D 2519/00064* (2013.01); *B65D 2519/00069* (2013.01); *B65D 2519/00079* (2013.01); *B65D 2519/0086* (2013.01); *B65D 2519/0099* (2013.01); *B65D 2519/00139* (2013.01); *B65D 2519/00169* (2013.01); *B65D 2519/00174* (2013.01); *B65D 2519/00184* (2013.01); *B65D 2519/00203* (2013.01); *B65D 2519/00208* (2013.01); *B65D 2519/00218* (2013.01); *B65D 2519/00273* (2013.01); *B65D 2519/00293* (2013.01); *B65D 2519/00323* (2013.01); *B65D 2519/00333* (2013.01); *B65D 2519/00432* (2013.01); *B65D 2519/00442* (2013.01); *B65D 2519/00562* (2013.01); *B65D 2519/00572* (2013.01); *B65D 2519/00611* (2013.01); *B65D 2519/00621* (2013.01); *B65D 2519/00825* (2013.01)

(58) Field of Classification Search
CPC ..... B65D 2519/00293; B65D 2519/00432; B65D 2519/00462
USPC ..... 108/51.11, 56.1, 56.3, 57.25
See application file for complete search history.

(56) References Cited

U.S. PATENT DOCUMENTS

| | | | | | |
|---|---|---|---|---|---|
| 3,568,912 | A | | 3/1971 | de Simas | |
| 3,626,860 | A | * | 12/1971 | Blatt | B65D 19/0026 108/51.3 |
| 3,719,157 | A | | 3/1973 | Arcocha et al. | |
| 3,771,466 | A | | 11/1973 | Ferdinand et al. | |
| 3,845,864 | A | | 11/1974 | Heinrich | |
| 4,183,845 | A | | 1/1980 | McGee | |
| 4,220,100 | A | | 9/1980 | Palomo et al. | |
| 5,320,048 | A | | 6/1994 | Feiner | |
| 5,463,965 | A | | 11/1995 | Cordrey | |
| 6,135,287 | A | * | 10/2000 | Hartwall | B65D 19/18 206/600 |
| 6,192,807 | B1 | | 2/2001 | Mason | |
| 6,250,234 | B1 | * | 6/2001 | Apps | B29C 65/02 108/57.25 |
| 8,424,469 | B2 | * | 4/2013 | Shuert | B65D 19/0073 108/57.27 |
| 8,469,329 | B2 | | 6/2013 | Tygard | |
| 8,671,848 | B2 | * | 3/2014 | Randall | B65D 19/0095 108/51.11 |
| 8,813,660 | B2 | * | 8/2014 | Linares | B65D 19/0095 108/57.25 |
| 2003/0094124 | A1 | * | 5/2003 | Wishart | B65D 19/38 108/51.11 |
| 2003/0189152 | A1 | * | 10/2003 | Elder | B65D 19/0036 248/346.02 |
| 2005/0263043 | A1 | * | 12/2005 | Proudlove | B65D 19/0018 108/56.3 |
| 2006/0075939 | A1 | * | 4/2006 | Shuert | B65D 19/0016 108/57.25 |
| 2008/0066657 | A1 | * | 3/2008 | Kuo | B65D 19/0095 108/57.19 |
| 2009/0246461 | A1 | | 10/2009 | Linares | |
| 2010/0043678 | A1 | | 2/2010 | Linares | |
| 2010/0071994 | A1 | | 3/2010 | Tseng | |
| 2011/0303128 | A1 | | 12/2011 | Linares | |
| 2012/0291678 | A1 | * | 11/2012 | Howland | B65D 19/0018 108/53.3 |
| 2013/0061784 | A1 | * | 3/2013 | Kessler | B65D 19/38 108/57.25 |
| 2013/0174762 | A1 | * | 7/2013 | Hedley | B65D 19/0026 108/50.11 |
| 2014/0251190 | A1 | * | 9/2014 | Kessler | B65D 19/38 108/57.25 |
| 2014/0283714 | A1 | * | 9/2014 | Wahl | B65D 19/0016 108/51.11 |

FOREIGN PATENT DOCUMENTS

| | | | | |
|---|---|---|---|---|
| JP | 2005035650 | A | | 2/2005 |
| NL | 9002094 | | * | 4/1992 |
| WO | 2010128260 | | * | 11/2010 |
| WO | 2014142511 | A1 | | 9/2014 |

* cited by examiner

PALLET HILO FORK GUARD, A COATED INSERT INCORPORATED INTO SUCH AS A VEHICLE PASSENGER COMPARTMENT SHELF, AND AN ASSEMBLEABLE AND PLASTIC COATED CONTAINERS FOR HOLDING BAGGED ITEMS

CROSS-REFERENCE TO RELATED APPLICATIONS

This Application claims the benefit of U.S. Provisional Application 61/969,633 filed on Mar. 24, 2014, the contents of which is incorporated herein in its entirety.

FIELD OF THE INVENTION

The present invention discloses a variety of products, each of which is coated with a plasticized spray material including both known and proprietary (trade secret) formulas. Specifically, a variety of products are provided, each of which incorporate the plasticized coating. These include, in a first non-limiting example, a vehicle compartment (e.g., trunk) supported shelf exhibiting a planar shaped and coated insert material surrounded by an outer tubing structure.

BACKGROUND OF THE INVENTION

The prior art is documented with examples of cargo supporting articles and assemblies. An example of a first type of display shelving is set forth in U.S. Pat. No. 3,845,864 to Heinrich, which discloses an improved shelf molded from a synthetic plastic material incorporating longitudinal embedded reinforcing bars, slotted ends for the reception and concealment of mounting brackets and a specially contoured top and bottom surface for aesthetic and functional purposes.

Other assemblies are directed to reinforced cargo pallets and related containers, a first example of which is set forth in U.S. Pat. No. 3,568,912, to de Simas, and which discloses a container portion with cutouts at the bottom of the sidewalls for receiving the tines of a forklift truck. The cutouts include vertical flaps extending into the container from the sides of the cutouts for positioning on the flaps a flat base on which packaged goods are places. An elongate U-shaped bracket extends over the upper edge of the cutouts frictionally engaging the sidewalls of the container. The brackets provides a durable bearing surface for the tines of a forklift truck and include a flat edge extending into the container above the flat base on which packaged goods rest for positioning the base between the flat edge of the bracket and the cutout flaps of the container walls.

Reference is also made to the partially replaceable pallet of WO 2014/142511 which is characterized by a plurality of body panels arranged so as to form an internal space, at least one of the panels having an insertion hole for making the internal space communicate with the outside. Also disclosed are a plurality of corner keys for integrally connecting the end parts of two adjacent body panels. A fork guard is detachably connected to the insertion hole. In this manner, the parts frequently fractured and worn are made are made to be detachably attached so as to facilitate a repair of the pallet by a partial replacement, thus considerably reducing the distribution costs and improving recycling of the resources.

Finally, reference is also made to various applicating assemblies such as for plastic coating paperboard type containers. A first example of this is set forth in the paperboard coating machine of Monroe, U.S. Pat. No. 3,207,049, which teaches receiving blanks of paperboard coated with a thermoplastic material and having foldable end closure panels defined therein. A forming mechanism includes a mandrel disposed for movement about an axis of rotation and adapted to receive the open-ended blank. A plurality of stations successively fold, heat, close, and seal the end closure panels.

Linares, US 2011/0303128, further teaches a pallet exhibiting a three dimensional shaped and buoyant inducing body with enhanced load supporting capabilities. The body exhibits a rectangular profile and is constructed of at least one of a corrugated paperboard, plastic or composite material and coated with a plasticized spray. An inner core defined within a three dimensional interior of the body is constructed of any plural arrangement of inner extending, interconnected and frame defining components, at least one of the components and/or the outer surfaces being coated with a plasticized spray. The inner constructed core can further include any of a structural paperboard, bamboo, other tubular material, or structural foam. In a further variant, a standard pallet design of upper and lower cross pieces separated by spaced apart bridge pieces is provided, and in which the individual members are each configured with structurally defined inner cores according to any of the above construction.

Also referenced by further example is the article, assembly and process for producing a waterproof, degradation resistant and increased structural supported stiffener insert incorporated into a composite pallet construction. A first material, such as a waterproofing and/or degradation preventing spray or coating, is applied to each of exterior or interior locations of the body. A second material, such as a composite plastic, is applied over the first material according to a built-up thickness about the exterior of the body and in order to encapsulate the body.

SUMMARY OF THE INVENTION

The present inventions disclose, in a first variant, a structurally supporting shelf article having a body and a plasticized coating applied to at least an exterior of the article. The body further includes a planar shaped insert surrounded by a tubular frame.

Mounting brackets extending from opposite ends of selected tubular frame members for supporting said planar body at an elevated location. The tubular frame can exhibit any of a round or rectangular cross sectional shape. The insert can also be constructed of any of a wood, cardboard, sandwiched foam or composite material as well as including any of a metal, angle iron, bamboo or composite material.

In a further variant, a structurally supporting pallet article includes a body incorporating a planar shaped upper supporting surface, the body further including rectangular shaped reinforcing brackets incorporated into a structurally supporting underside locations of the body and which are adapted to receive the inserting forks of a forklift device. A plasticized coating can be applied to at least an exterior of the body.

In another variant, a reinforced and volume supporting paperboard article includes a four-sided box like structure assembleable upon a pallet-shaped base with a lid affixing to the assembled sides. The body may constitute a cardboard constructed barrel with reinforcing upper and lower tubular support portions, the lid affixing over an open top of the barrel. In a further application, the body is a cardboard box with upper extending flaps.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to the several illustrations, the present invention discloses a variety of products, each of which is coated with a plasticized spray material, the formula for which can include both known and proprietary compositions. For purposes of the present description, the composition and techniques surrounding the application of a plastic spray material, such as to a wooden or paperboard/corrugated material, contemplate such as any type of polystyrene, polyurethane or other material which can be spray applied or flowed over the exposed surfaces of the substratum material in such a way as to maintain it structural integrity while also delivering long term environmental protection.

Without limitation, the term plasticized coating can apply to any type of water-based polymer providing barrier and functional coatings for flexible film packaging, paperboard, and corrugated cartons. Such may further incorporate water-based surface modifiers, additives and polymers for numerous industries including wood care, industrial coatings, inks, fibers, composites, and construction products.

Figure 1:
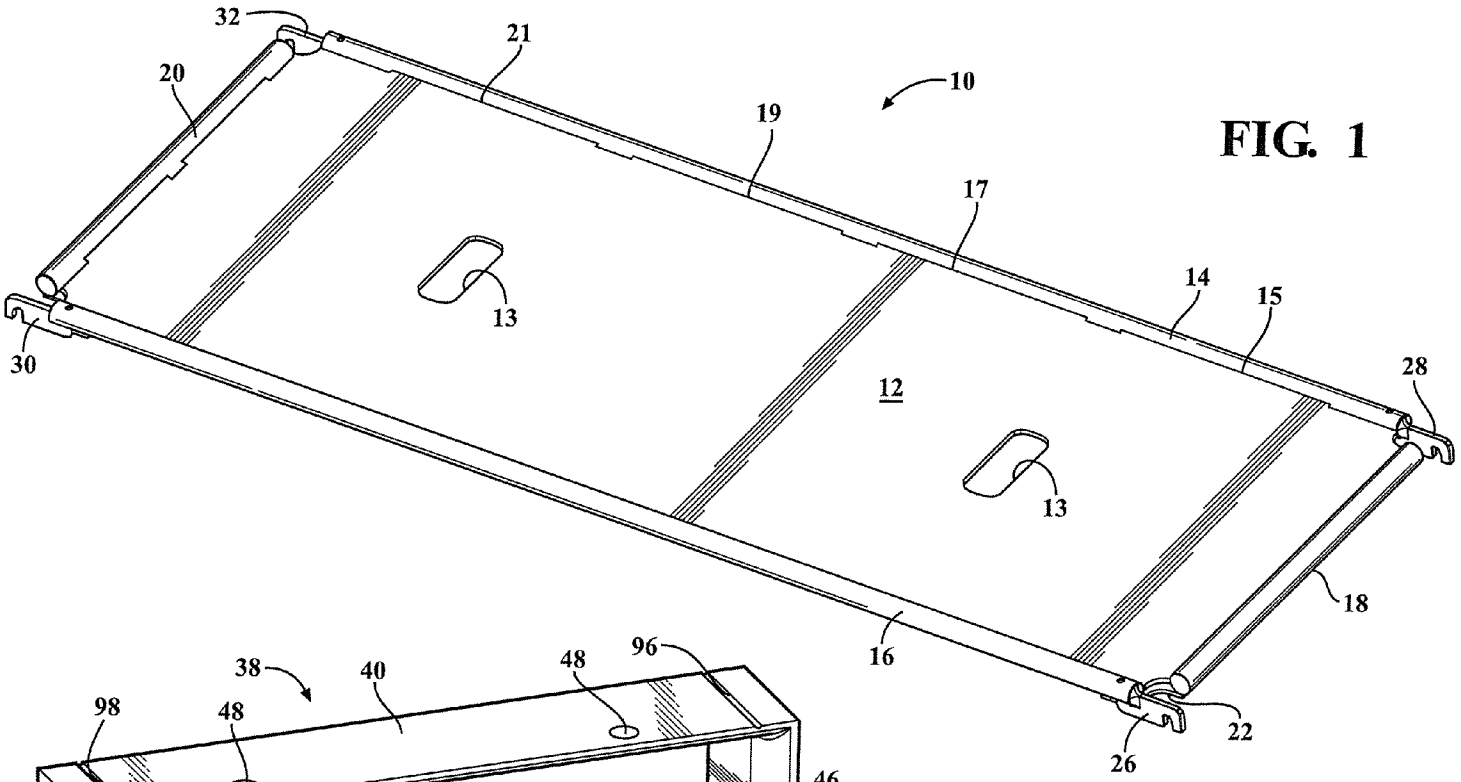
FIG. 1 is a perspective illustration of a vehicle compartment (e.g., trunk) supported shelf exhibiting a planar shaped and coated insert material surrounded by an outer tubing structure.

Referring now to FIG. 1, a perspective illustration of a vehicle compartment (e.g., trunk) supported shelf, generally at 10, and exhibiting a planar shaped and coated insert material surrounded by an outer tubing structure. As further supported by FIG. 2, which is an enlarged end perspective of the shelf of FIG. 1, the insert, at 12, exhibits a generally planar shape with a minor thickness (such as without limitation under ¼") and which can include any type of wood, cardboard, sandwiched foam or other composite or rigid paperboard material having specified length, width and thickness dimensions.

To provide with additional strength, a coating of plasticized material, such as including that generally described above, can be sprayed or applied in any other non-limiting fashion, is applied over the exposed surfaces of the planar shaped insert 12. As further shown, the insert 12 can include inner cutouts, such as depicted by closed inner perimeter surfaces 13, which are formed therethrough at selected locations.

The plasticized material, such as described above, is capable of being applied to any of the other items described in the present application, and can include any suitable composition not limited to any known blends in a liquid state and settable polymer. The plasticized coating can further include an aggregate or other non-liquid entrained particulate or other component, such as which is intermixed with the liquid base structure of the coating and subsequently applied with a high pressure sprayer or the like. Without limitation, the present invention further contemplates the substitution of any proprietary or trade secure composition to further enhance the operational properties of the article thus coated.

Referring again to FIGS. 1-2, the insert 12 is supported about its outer periphery by a tubular construction including side extending members 14 and 16, with opposite end extending members 18 and 20. As further depicted in FIG. 2, one non-limiting variant contemplates the side and end extending members 14-20 being structurally inter-connected at reinforce corner locations, such as is shown at 22 for selected corner connection between side extending member 16 and end connecting member 18.

Although not shown, it is envisioned that the insert can be rigidly reinforced at each interconnecting corner location. Alternatively, the tubular outer frame can be provided as a one piece and outer perimeter extending frame, such as which is integrally formed with the round tubular construction of the side 14/16 and end 18/20 extending frame members and upon which the planar insert 12 can be secured, such as by adhesives or fasteners, in order to provide adequate load bearing support to the overall assembly.

Figure 2:
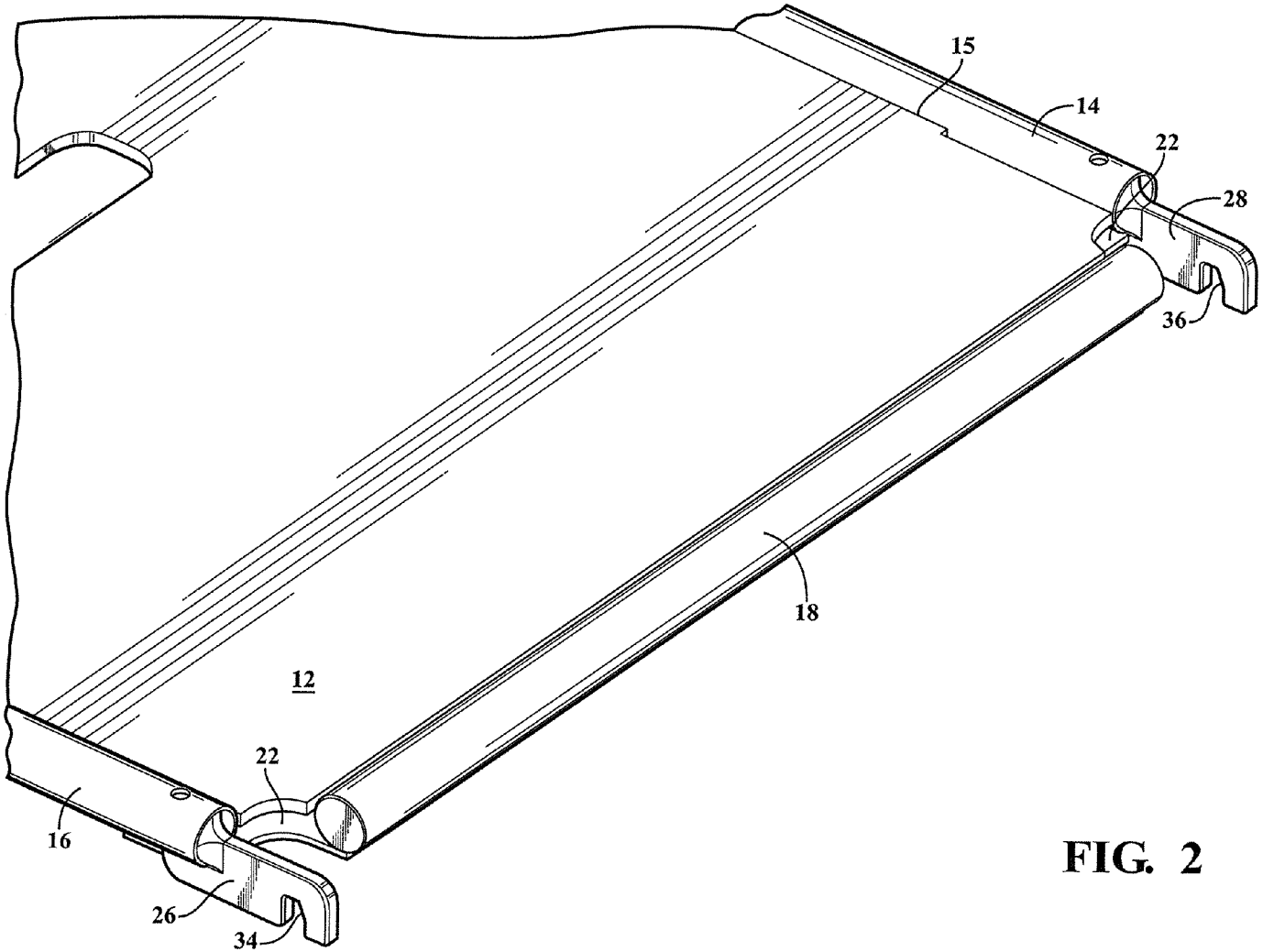
FIG. 2 is an enlarged end perspective of the shelf of FIG. 1 exhibiting an outer frame with a round outer tubular construction in combination with a planar insert which can be any of a wood, cardboard, sandwiched foam or other composite material.

As further shown in FIGS. 1-2, and as best referenced by selected side extending member 14, each of the tubular members can include inner extending slots or notches, these defined in either partially or entirely their extending lengths and within which mating edge projecting locations of the planar insert 12 (see in particular at 15, 17, 19 and 21) seat in extending fashion into interior of the selected side tubular member 14 in order to provide additional structural and load carrying support to the overall assembly. Without limitation, the present invention contemplates a variety of constructions, not limited to those described herein, for affixing the planar shaped insert 12 to the outer perimeter defining tubular frame 14-20. As further best shown in FIG. 2, the insert 12 includes a reinforced inner layer (depicted by the corner locations referenced by edges 22).

Also, and while the tubular members 14-20 and insert inner layer 22 may include a metal, it is also envisioned that other durable plastics or other such materials can be substituted and such as which can be further molded or otherwise formed with the insert 12 and as opposed to being independently produced and subsequently joined together. It is further envisioned that a plastic spray coating as described above can be applied in one step over the entire assembly (insert 12, tubular members 14-20 and sub-platform brackets 22).

Also depicted are end extending mounting brackets 26, 28, 30 and 32 which are shown projecting integrally from opposite ends of the side extending tubular members 14 and 16. As best shown by selected end extending mounting brackets 26 and 28 in FIG. 2, each includes a contoured underside profile including a recessed engagement notch, see further at 34 and 36, which is adapted to secure any type of railing or fixed support (not shown) such as which can be incorporated into a vehicle compartment not limited to a shelf-defining space in the instance of a delivery van or the like and in order to mount the planar shaped insert body at an elevated location. It is also envisioned that a variation of the shelf defining insert can be integrated into a supporting assembly in use with a trunk located compartment, and in such instance with the end extending and mounting brackets engaging fixed supporting locations integrated into the vehicle (trunk) architecture.

Figure 3:
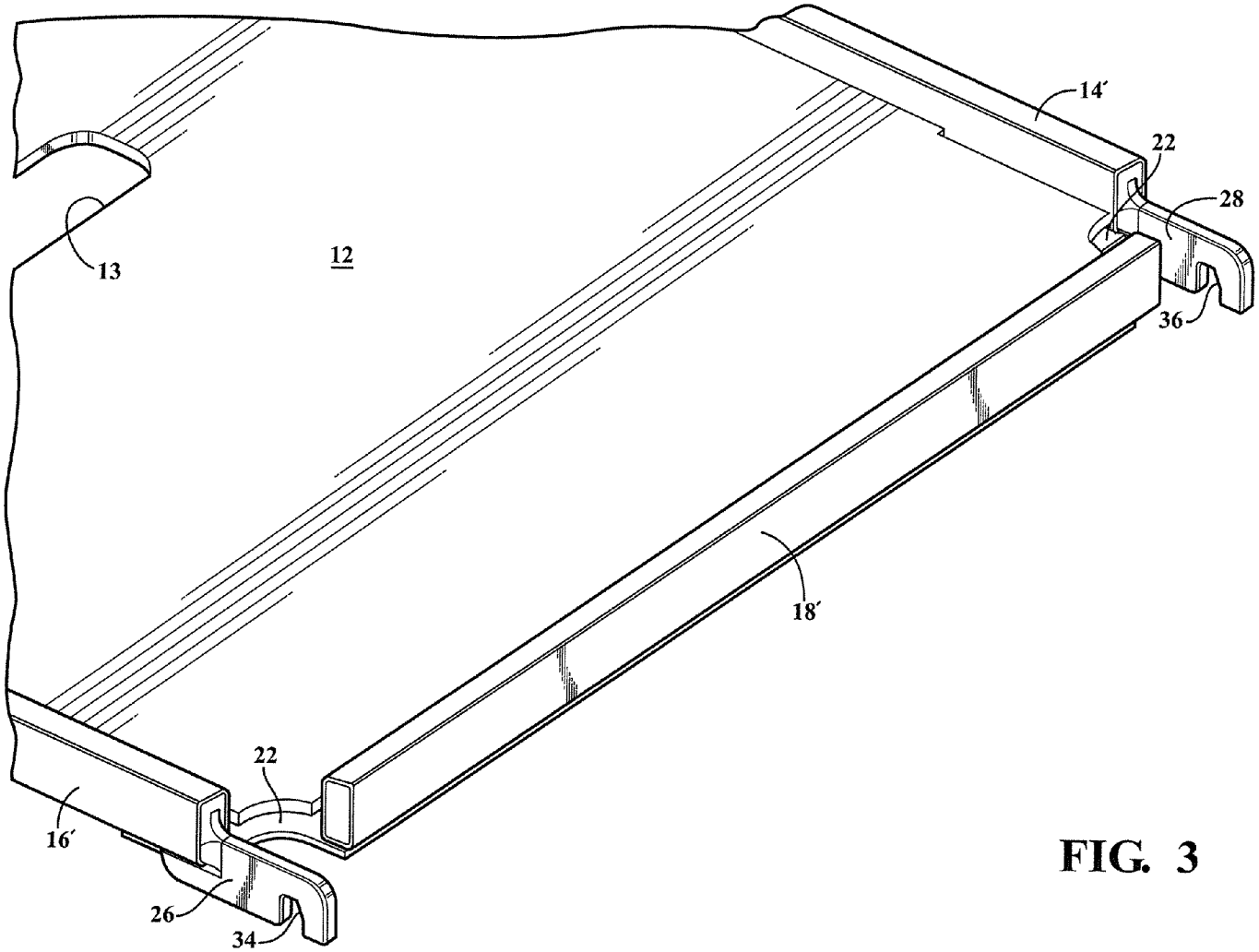
FIG. 3 is an illustration similar to FIG. 2 of an alternate variant of supported shelf in which the round tubular construction is substituted by an outer perimeter defining and interconnected rectangular tubing, such also envisioning the use of any of angle iron, bamboo or other composite material.

FIG. 3 is an illustration similar to FIG. 2 of an alternate variant of supported shelf, and in which the round tubular construction is substituted by an outer perimeter defining and interconnected rectangular cross sectional defined tubing (see as depicted by selected perimeter defining members 14', 16' and 18'). Beyond that shown, it is also envisioned that any variety of materials, not limited to any of angle iron, bamboo or other composite material (such as further including any one or more of a plastic, metal or cellulosic based material), can be substituted for that described herein and without departing from the overall scope of the invention.

Figure 4:
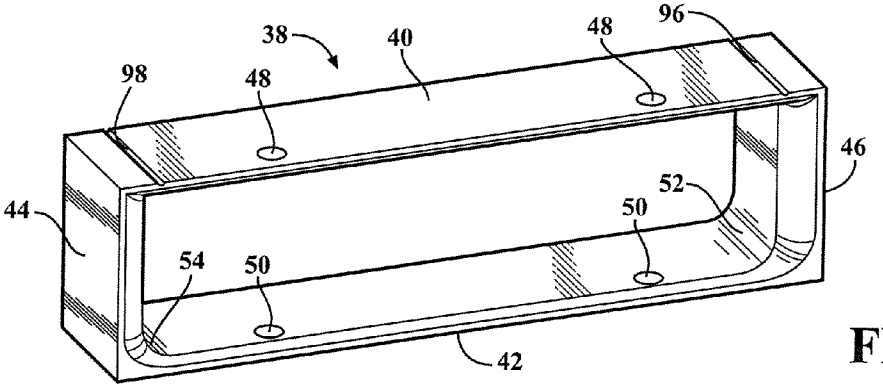
FIG. 4 is a perspective of a pallet hi-lo fork guard exhibiting an open four sided construction and which is constructed of a plastic or any composite material.

Proceeding to FIG. 4, a perspective is generally shown of a second example of plasticized coated article in the form of pallet incorporated guard, generally at 38, for protecting against structural damage caused by a hi-lo lift fork. As shown, the pallet guard is constructed of a plastic or other composite article exhibiting a generally four sided frame and defining an open interior, as depicted by top 40, bottom 42, first connected side 44 and second connected side 46.

As best shown in FIG. 4, the four sided bracket includes apertures, see aligning pairs 48 and 50, which are formed through the top 40 and bottom 42. The inner perimeter defined in the bracket 38 further includes rounded inner edges (see as best shown at 52 and 54) which, as will be further described, function when mounted to the underside of the pallet article in order to assist in both deflecting a misaligned and inserting fork associated with the hi-lo lift. As will be described in more detail with reference to FIG. 5, the material construction of the pallet guard 38 is further is further such that it provides a convenience fracture location for absorbing impact damages caused by the hi-lo fork, and without inflicting any substantial damage to the structural integrity of the pallet.

Figure 5:
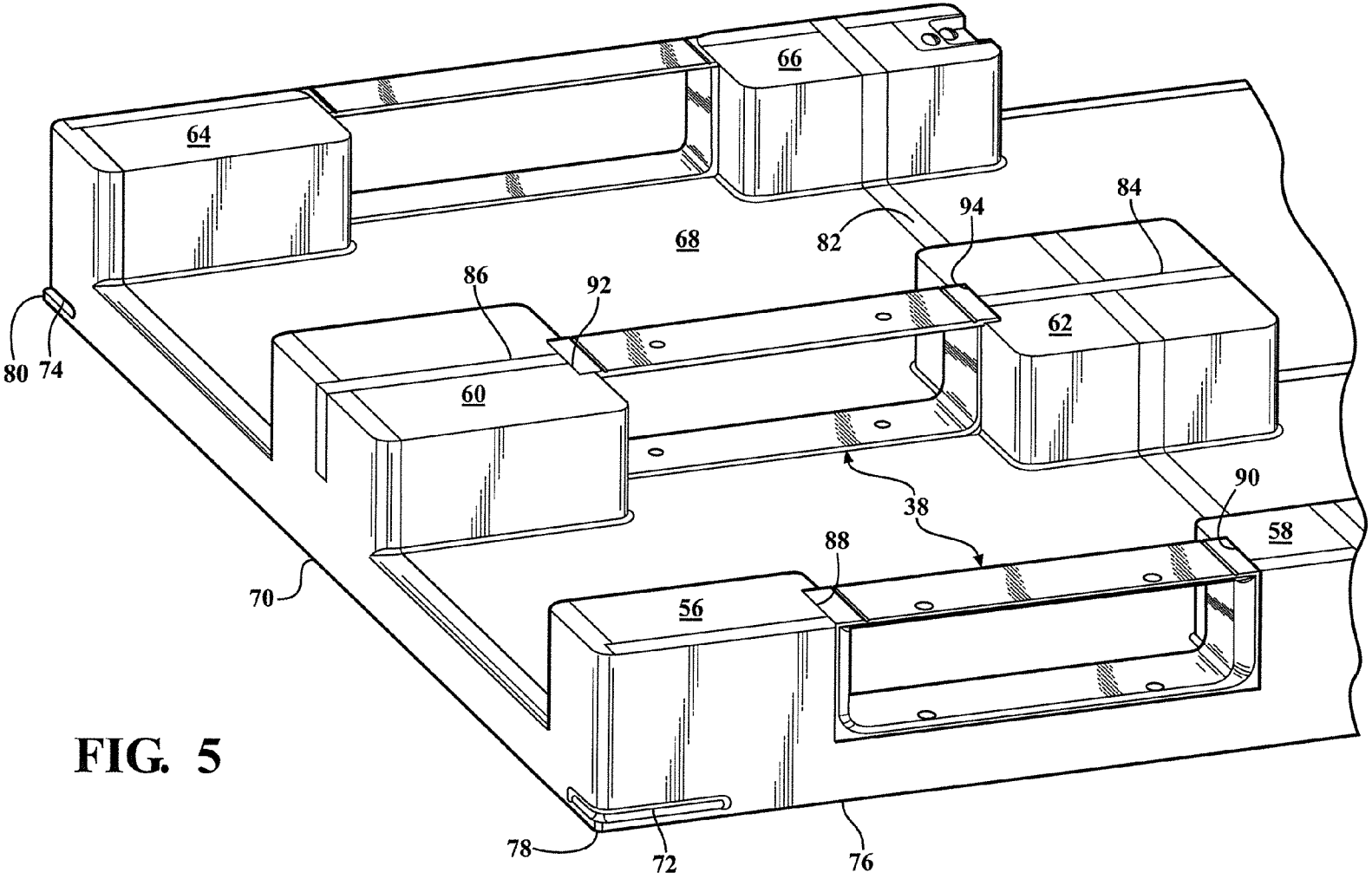
FIG. 5 is an environmental illustration of the pallet fork guard of FIG. 4 incorporated into a plurality of underside located structural supporting locations associated with a likewise coated pallet construction, the pallet including spaced apart underside projections which define hilo fork receiving areas, the fork guards being initially or replaceably secured in extending fashion between the underside projections so that they guide the insertion of the hi-lo forks, and so that the guards function as sacrificial fracture portions in response to pallet fork misalignment and which minimize the instance of fracturing of the pallet structure.

Proceeding to FIG. 5, an environmental illustration is provided of a substantial portion of a pallet incorporating any plurality of the pallet fork guards 38 of FIG. 4, these incorporated into a plurality of underside located structural supporting locations associated with the pallet construction, and such as which can be installed by any of mechanical or chemical affixing to the underside recessed locations of the pallet not limited to the use of mounting bolts or other in-molding techniques. As shown, the pallet includes spaced apart underside projections, see pairs of spaced apart projections each exhibiting a multi-sided (rectangular three dimensional) shape and depicted at 56 & 58, 60 & 62, and 64 & 66. Additional structural portions are defined along a remote edge of the pallet not evident in FIG. 5, the supporting portions project from underside locations of a bottom surface 68 of a structurally supporting pallet article 70, which is depicted in inverted fashion.

An inner core or insert portion of the three dimensional pallet 70 can be constructed of any of a wood, cardboard, form or other type of structurally supporting material. Also depicted at 72 and 74 are "L" shape recesses defined in upper and corner edge proximate locations of the pallet (see further top surface 76). In use, a heavy duty plasticized wrap applied over the surface supported cargo (not shown) can be tensioned in such a fashion that it grips the upper corners of the pallet (see further at 78 and 80) and engages within the "L" shaped recesses.

The insert or core of the pallet can further incorporate spinal or other grid shaped support portions, see at 82, 84, 86 et seq., for increasing its structural integrity. The support portions can include, but are not limited to, reinforcing brackets which installed in an overlapping manner as shown in order to provide additional structurally rigidity to the underside of the pallet. As further shown in FIG. 5, the support portions define three dimensional and elongated strap-like elements and which seat within receiving channels associated with the extending underside locations of the pallet.

In the partial view of FIG. 5, a plurality of three brackets shaped guards 38 are further depicted as mounted in extending fashion between the pairs of support portions, with a further plurality of three similarly constructed guards 38 being hidden from view. As shown in FIG. 5, and according to one non-limiting mounting arrangement, recessed or seating profiles can be formed in opposing spaced apart edges of selected ones of the structural portions (see as depicted at 88/90 and 92/94 for structural portions 56/58 and 60/62), such that the opposite ends 44 and 46 of the bracket 38 can be slid into place as shown, this occurring again in combination or alternate to other mounting techniques for securing to the underside locations of the pallet article.

To this end, adhesives or mounting fasteners (not shown) can again be provided for anchoring the brackets in place against the underside locations of the pallet 70, the brackets providing sufficient structural integrity. Preferentially, the brackets 38 are removably mounted to the pallet such that, in response to structurally absorbing the force of a misdirected hi-lo fork, any number of the brackets can be quickly removed and replaced.

As further shown, the brackets 38 each include weakened fracture locations (see at 96 and 98 in FIG. 4) such as which are configured along the opposite edge locations of the exposed side 40 of the underside mounted bracket and which, in operation, localize the damage of the misdirected fork to the bracket (this potentially including the shearing off of the side 40). In this fashion, the fork guards disclosed herein are initially or replace-ably secured in extending fashion between the underside projections, so that they guide the insertion of the hilo forks and so that the guards function as sacrificial fracture portions in response to pallet fork misalignment and which minimize the instance of fracturing of the pallet structure.

As with the other articles described herein, the pallet can also optionally exhibit any plasticized coating, including proprietary compositions, which assist in lending additional structural integrity and environmental protection (such as against moisture). Other features, such as GPS tracking and radio frequency identification protocols (Rfid) can also be integrated into the pallet article described.

Figure 6:
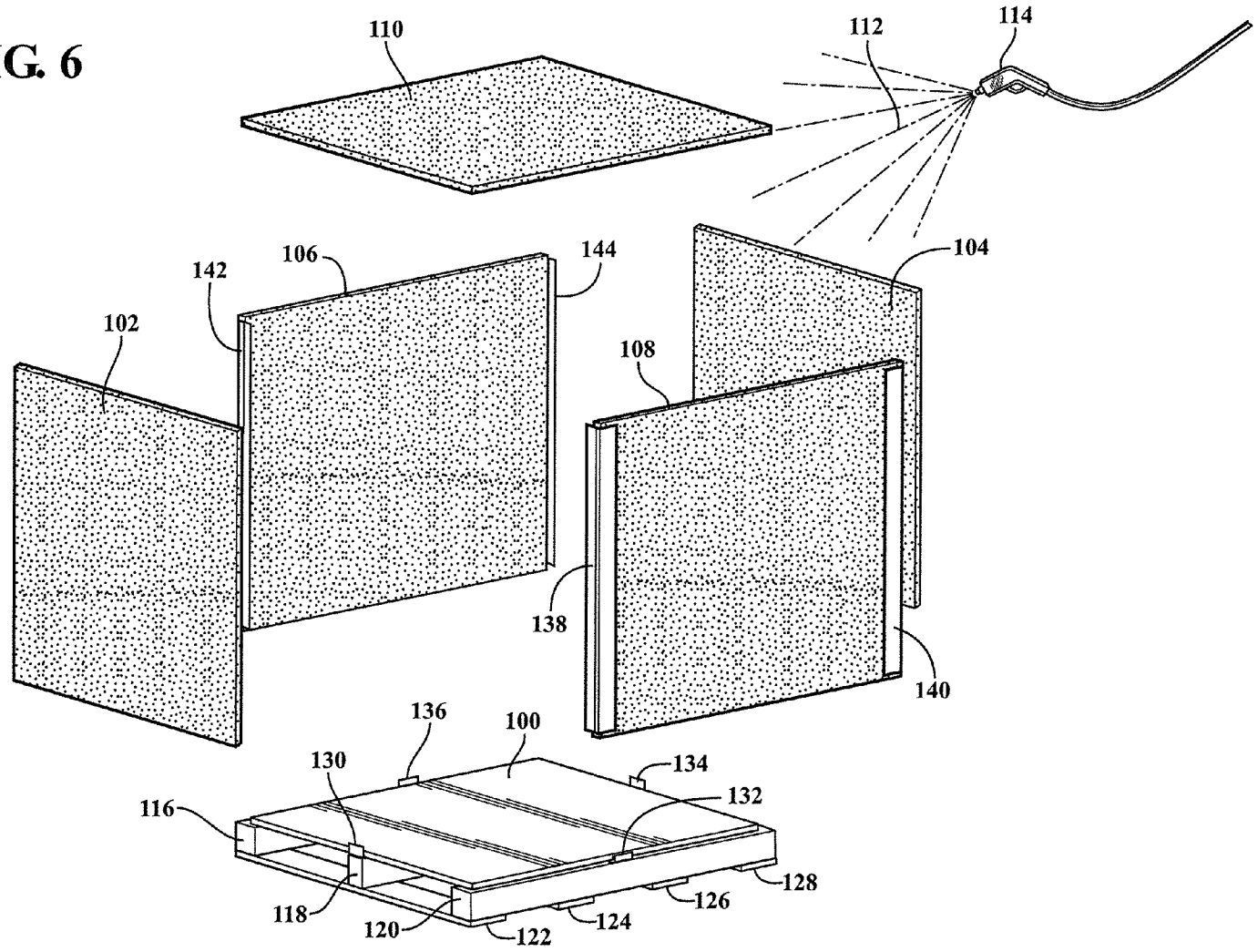
FIG. 6 is an exploded view of an assemble able and box-like container including a portable and pallet-like structured base, upon which is assembled four sides and a top or lid, the planar components all constructed of a plywood, sandwiched foam or other composite, over which is sprayed a proprietary plastic coating.

Proceeding to FIG. 6, an exploded view is shown of an assemble able and box-like container including a portable and pallet-like structured base (see top surface 100), upon which is assembled four interconnecting and structurally supporting sides 102, 104, 106 and 108, along with a top or lid 110. The planar components can all be constructed of a plywood, sandwiched foam or other composite, and over which is sprayed any type of known or proprietary plastic coating as described above, see as referenced at 112 and such as is applied through a pressurized delivery line by a spray gun or wand 114.

The pallet base 100 can also include spaced apart and underside attached structural supporting members 116, 118 and 120 (these illustrating a rectangular cross section), and underneath which are engaged a further plurality of cross-wise extending and spaced apart bottom supports 122, 124, 126 and 128. Also shown are upper extending side tabs 130, 132, 134 and 136 associated with mid-point perimeter locations of the top pallet surface 100, these facilitating location and assembly of the upper structural portions 102-108 upon the pallet base.

As further shown, selected sides 106 and 108 can include opposite edge mounted brackets, see further at 138/140 for side 106 and 142/144 for side 108, each of the brackets exhibiting an "L" shape in cross section which facilitates inter assembly upon and around the top pallet surface 100, such as through the addition of mounting fasteners and/or adhesives. Without limitation, the assembled and coated enclosure can function, in one non-limiting application, as a box for containing volumes of edible products (e.g. tomato paste containers, etc.).

Figure 7:
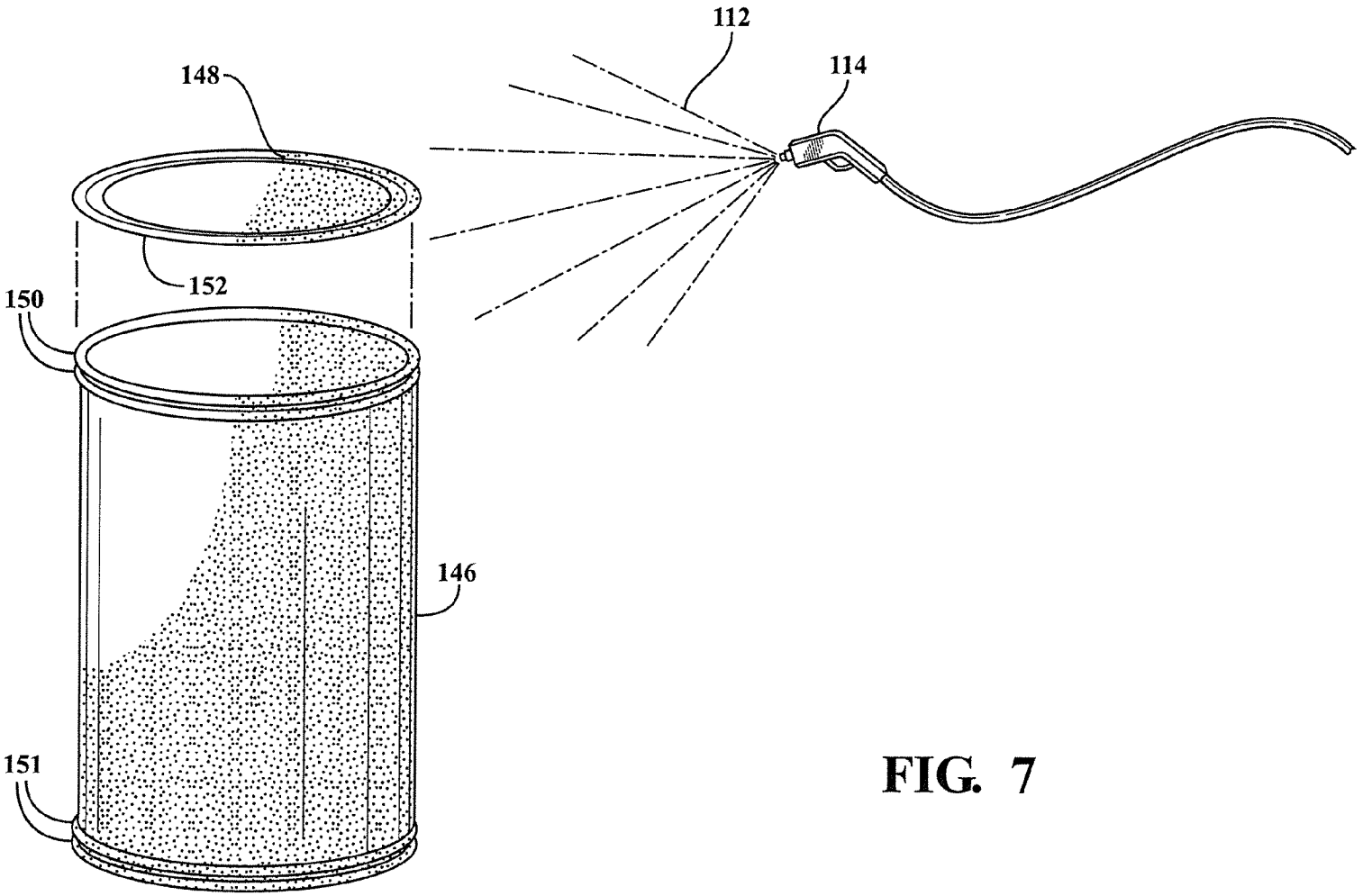
FIG. 7 is a partially exploded illustration of a cardboard shaped barrel, with a base and lid, over which is applied a plasticized spray coating of proprietary composition.

FIG. 7 is a partially exploded illustration of a cardboard constructed and shaped barrel, this exhibiting a base 146 and lid 148, and over which is applied a plasticized spray coating (see as previously shown at 112 applied through a pressurized line and spray gun 114), the plastic spray again including both known and proprietary compositions. The barrel can include upper and lower tubular support portions, see at 150 and 151, the lid also including an outer perimeter portion 152 which can seal over the open top of the body. Without limitation, the barrel can incorporate other composite materials including any of those described in reference to the other disclosed embodiments and which, in combination with the plasticized spray or other coating employed, provides enhanced structural supporting properties.

Figure 8:
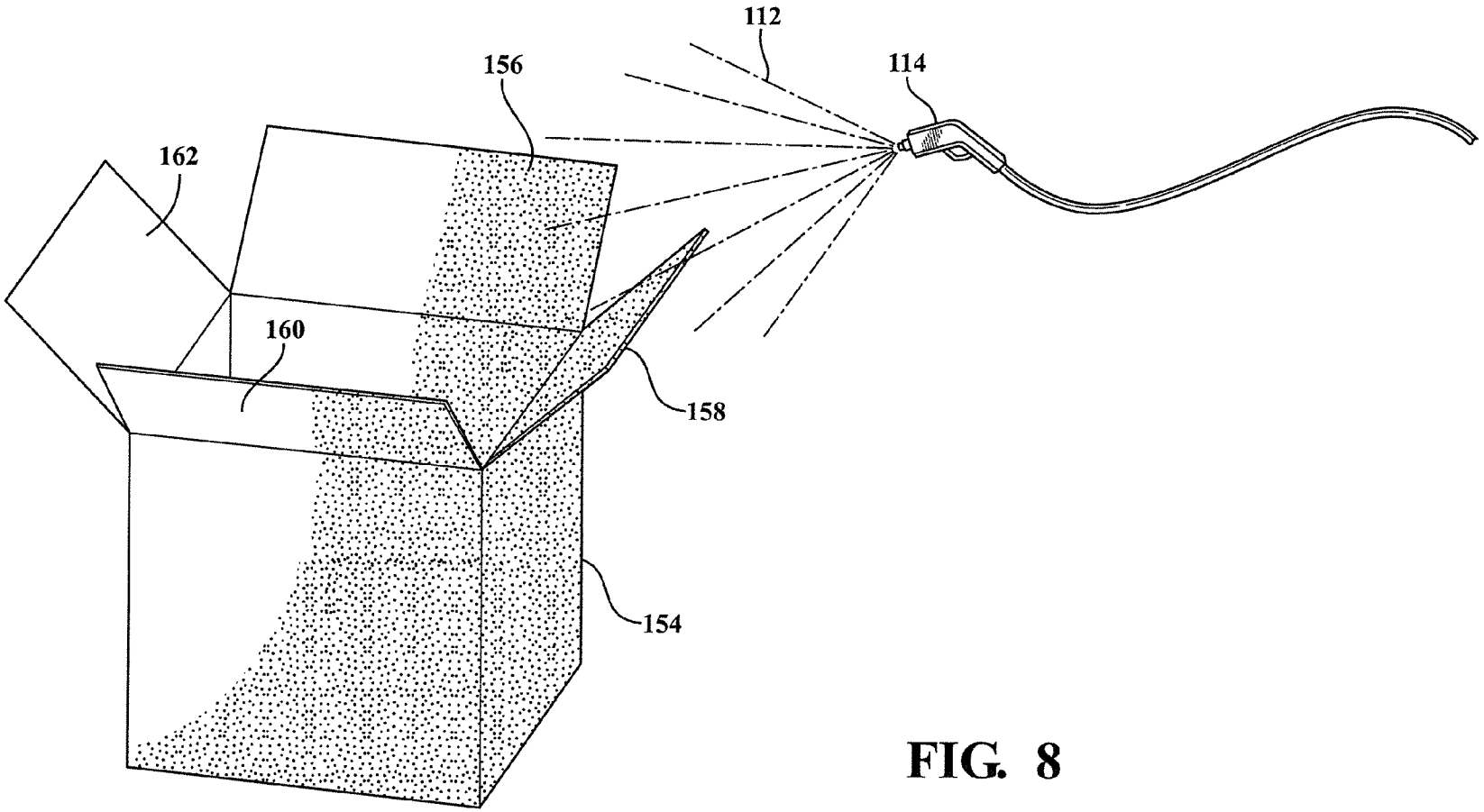
FIG. 8 is an illustration of a cardboard box with upper extending side and end flaps, each of which is likewise spray coated with the proprietary plastic coating.

Finally, FIG. 8 is an illustration of a cardboard box 154 with upper extending side and end flaps (collectively referenced by flaps 156, 158, 160 and 162). A spray coat of any proprietary (trade secret) or other plasticized material can be applied in a similar pressurized manner through the spray gun 114 and provide for enhanced structural retention and strength characteristics than is provided by the cardboard material alone.

Having described my invention, other and additional preferred embodiments will become apparent to those skilled in the art to which it pertains, and without deviating from the scope of the appended claims:

I claim:

1. A structurally supporting pallet article, comprising:

a body incorporating a planar shaped upper supporting surface and, on an opposite surface, a plurality of spaced apart, underside projecting and structurally supporting portions;

a plurality of rectangular shaped reinforcing brackets, each being replace-ably installed between opposing pairs of said structurally supporting underside portions and so that aligning rows of said brackets are adapted to receive the inserting forks of a forklift device; and fracture locations being configured within an exposed side of each bracket coplanar with ground engagement surfaces of said support portions, said fracture locations further including reduced thickness portions defined along width extending directions of the exposed side in proximity to the structurally supporting portions such that, upon a misdirected application of force from the fork, the exposed side is caused to shear off from a remainder of said bracket without damage to the pallet body.

2. The article as described in claim 1, further comprising a plasticized coating applied to at least an exterior of said body.

3. The article as described in claim 1, further comprising an inner perimeter surface associated with said reinforcing brackets exhibiting curved edges.

4. The article as described in claim 1, further comprising recessed seating profiles formed in opposing spaced apart edges of said structurally supporting portions for receiving interconnecting sides of said brackets in slide-in fashion.

5. The article as described in claim 1, further comprising mounting apertures formed into an inner-most extending side of each of said brackets.

6. The article as described in claim 1, further comprising reinforcing spinal support portions integrated into said structural supporting portions.

7. The article as described in claim 1, further comprising "L" shaped recesses defined in upper and corner edge proximate locations of the body and adapted to engage and tension a plasticized wrap applied over a cargo supported upon the upper surface.

* * * * *